US005291860A

United States Patent [19]

Quinn, Jr., Stanley B.

[11] Patent Number: 5,291,860

[45] Date of Patent: Mar. 8, 1994

[54] VCT SYSTEM WITH CONTROL VALVE BIAS AT LOW PRESSURES AND UNBIASED CONTROL AT NORMAL OPERATING PRESSURES

[75] Inventor: Quinn, Jr., Stanley B., Ithaca, N.Y.

[73] Assignee: Borg-Warner Automotive, Inc., Sterling Heights, Mich.

[21] Appl. No.: 26,398

[22] Filed: Mar. 4, 1993

[51] Int. Cl.[5] ..... F01L 1/34; F15B 17/02

[52] U.S. Cl. ..... 123/90.17; 123/90.31; 91/461; 92/130 A; 92/131; 464/2

[58] Field of Search ..... 123/90.15, 90.17, 90.31; 91/461; 92/130 A, 131; 464/1, 2, 160

[56] References Cited

U.S. PATENT DOCUMENTS

| | | | |
|---|---|---|---|
| 4,877,217 | 10/1989 | Peil et al. | 92/130 A |
| 5,002,023 | 3/1991 | Butterfield et al. | 123/90.15 |
| 5,056,477 | 10/1991 | Linder et al. | 123/90.17 |
| 5,107,804 | 4/1992 | Becker et al. | 123/90.17 |
| 5,117,784 | 6/1992 | Schechter et al. | 123/90.17 |
| 5,121,717 | 6/1992 | Simko et al. | 123/90.17 |
| 5,172,659 | 12/1992 | Butterfield et al. | 123/90.17 |
| 5,184,587 | 2/1993 | Quinn, Jr. et al. | 123/90.17 |
| 5,205,249 | 4/1993 | Markley et al. | 123/90.17 |
| 5,207,192 | 5/1993 | Smith | 123/90.17 |
| 5,218,935 | 6/1993 | Quinn, Jr. et al. | 123/90.17 |

*Primary Examiner*—Tony M. Argenbright
*Assistant Examiner*—Weilun Lo
*Attorney, Agent, or Firm*—Willian Brinks Hofer Gilson & Lione

[57] ABSTRACT

The camshaft tends to change in reaction to pulses which it experiences during its normal operation, and it is permitted to change only in a given direction, either to advance or retard, by selectively blocking or permitting the flow of hydraulic fluid, preferably engine oil, through the return lines (194,196) from the recesses (132a, 132b) by controlling the position of a spool (800) within a valve body (798) of a control valve (792) in response to a signal indicative of an engine operating condition from an engine control unit (808). The spool is centered during normal operation when the hydraulic loads acting on its opposed ends by the action of springs (802, 804) that also act on the opposed ends of the spool are in balance. During periods of operation when system pressure is low, a biasing mechanism forces the spool to its full advance position.

23 Claims, 15 Drawing Sheets

VCT SYSTEM WITH CONTROL VALVE BIAS AT LOW PRESSURES AND UNBIASED CONTROL AT NORMAL OPERATING PRESSURES

FIELD OF THE INVENTION

This invention relates to an hydraulic control system for controlling the operation of a variable camshaft timing ("VCT") system of the type in which the position of the camshaft is circumferentially varied relative to the position of a crankshaft in reaction to torque reversals experienced by the camshaft during its normal operation. In such a VCT system, an hydraulic system is provided to effect the repositioning of the camshaft in reaction to such torque reversals, and a control system is provided to selectively permit or prevent the hydraulic system from effecting such repositioning. More specifically, the present invention relates to an improved hydraulic mechanism which biases the differential pressure control system ("DPCS") towards the full advance position during conditions of low pressure, but reverts to an unbiased condition during normal operating pressures.

BACKGROUND OF THE INVENTION

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_c$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_s$. The hydraulic force on the other end of the spool results from an hydraulic cylinder or other force multiplier which acts thereon in response to system hydraulic fluid at reduced pressure, $P_c$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

In some instances, however, it is desirable to position the spool valve to one side of null at zero or near-zero pressure, for example, when the engine is first started. The engine control unit would then always have the same known quantity, that is, the full advance position of the spool, with which to perform calculations during initial system calibration. In addition, the engine would be designed to start smoothly with the controlled cams fully advanced. The standard DPCS is unable to achieve these ends.

The aforementioned U.S. Patents are all incorporated by reference herein.

SUMMARY OF THE INVENTION

The control system of the present invention utilizes hydraulic force on both ends of the spool. The hydraulic force on one end results from directly applied hydraulic fluid from the engine oil gallery at full hydraulic pressure $P_s$. The hydraulic force on the other end of the spool results from an hydraulic cylinder or other force multiplier which acts thereon in response to system hydraulic fluid at reduced pressure $P_c$ from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

Preferably, the force multiplier which acts on the other end of the spool will exactly double the force acting on the one end of the spool, assuming equal hydraulic pressures acting on each. This can be accomplished by providing the hydraulic force multiplier with a piston whose cross-sectional area is exactly double the cross-sectional area of the end of the spool which is acted on directly by supply pressure $P_s$. In this way, the hydraulic forces acting on the spool will be exactly in balance when the hydraulic pressure within the force multiplier $P_c$ is exactly equal to one-half that of supply pressure $P_s$. This operating condition is achieved with a PWM solenoid duty cycle of 50%, a desirable value because it permits equal increases and decreases in force at the force multiplier end of the spool, to thereby move the spool in one direction or the other by the same amount and at the same rate by increasing or decreasing the duty cycle of the PWM solenoid.

Certain conditions may be present, however, where it is desirable to momentarily force the spool valve to its full advance position instead of allowing the spool valve to operate independently. One such condition occurs during initial start-up when supply pressure $P_s$ is zero or near-zero. By biasing the spool valve to its full advance position, the engine control unit always begins its control function from the same starting point, namely, the known position of the spool. One embodiment of the present invention modifies the conventional spool valve and hydraulic cylinder arrangement by relocating one of two springs, adding a third spring, adding a biasing bracket, and reconfiguring the hydraulic pressure lines. In an alternate embodiment, the conventional arrangement is modified by relocating one spring and employing a "nested piston" configuration to achieve the desired biasing.

Accordingly, it is an object of the present invention to provide an improved method and apparatus for controlling the operation of an hydraulic control valve of the spool type in an automotive variable camshaft timing system which utilizes oppositely acting, torque reversal reactive hydraulic means. More specifically, it is an object of the present invention to provide a biased DPCS at low operating pressures while maintaining a pressure-independent balance of the DPCS during normal operating pressures.

For a further understanding of the present invention and the objects thereof, attention is directed to the drawing and the following brief description thereof, to the detailed description of the preferred embodiment, and to the appended claims.

DETAILED DESCRIPTION OF THE PREFERRED EMBODIMENT

Figure 1:
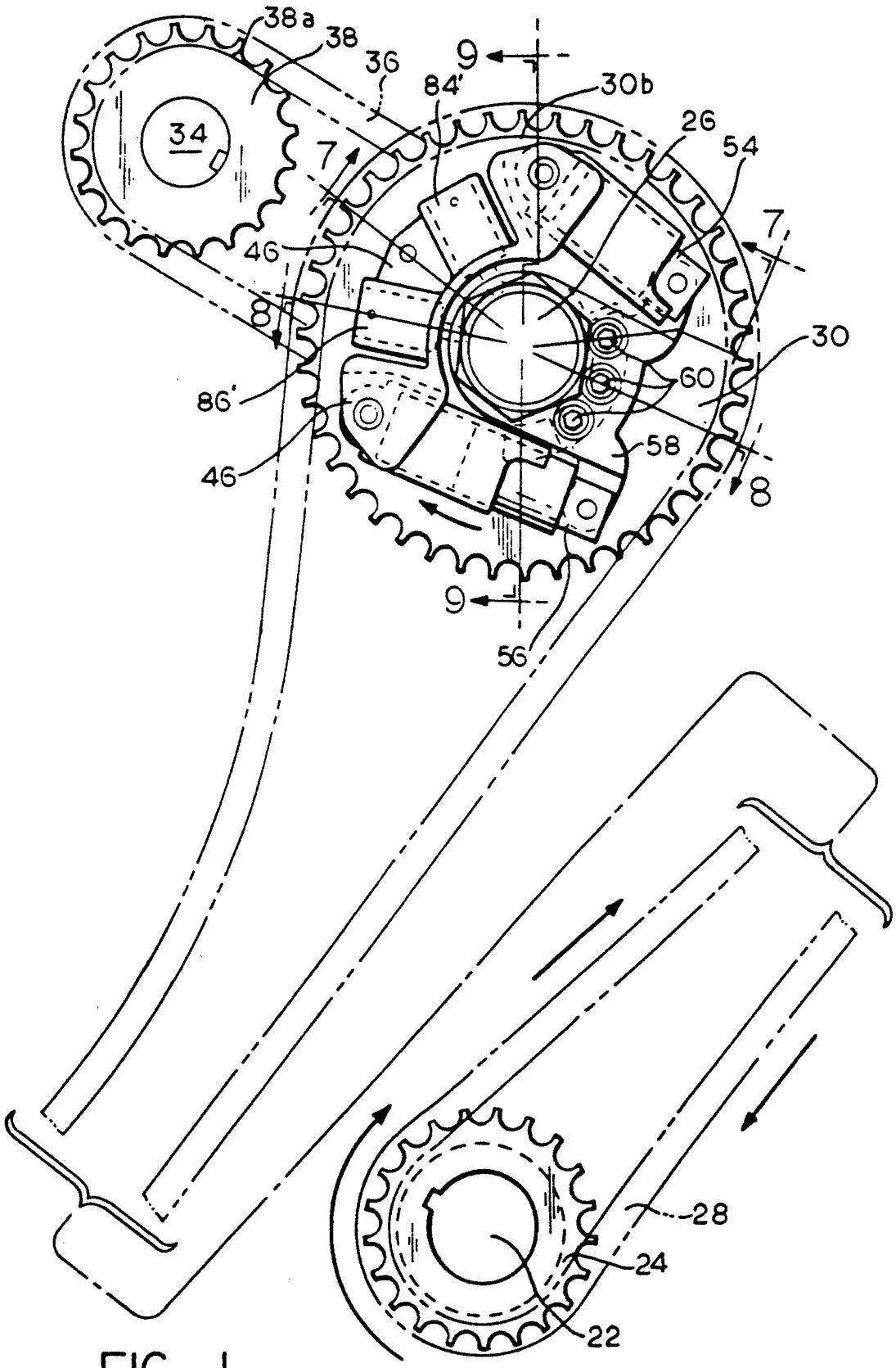
FIG. 1 is a fragmentary view of a dual camshaft internal combustion engine incorporating a conventional VCT arrangement, the view being taken on a plane extending transversely through the crankshaft and the camshafts and showing the intake camshaft in a retarded position relative to the crankshaft and the exhaust camshaft.

In the embodiment of FIGS. 1-9, a crankshaft 22 has a sprocket 24 keyed thereto, and rotation of the crankshaft 22 during the operation of the engine in which it is incorporated, otherwise not shown, is transmitted to an exhaust camshaft 26, that is, a camshaft which is used to operate the exhaust valves of the engine, by a chain 28 which is trained around the sprocket 24 and a sprocket 30 which is keyed to the camshaft 26. Although not shown, it is to be understood that suitable chain tighteners will be provided to ensure that the chain 28 is kept tight and relatively free of slack. As shown, the sprocket 30 is twice as large as the sprocket 24. This relationship results in a rotation of the camshaft 26 at a rate of one-half that of the crankshaft 22, which is proper for a 4-cycle engine. It is to be understood that the use of a belt in place of the chain 28 is also contemplated.

Figure 6:
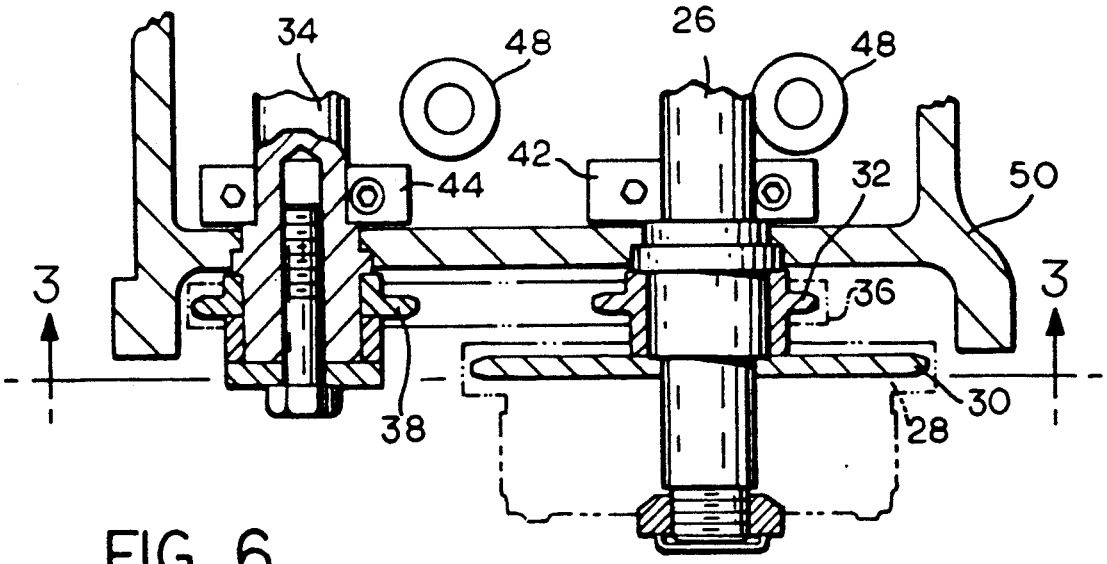
FIG. 6 is a fragmentary view taken on line 6—6 of FIG. 4.
Figure 3:
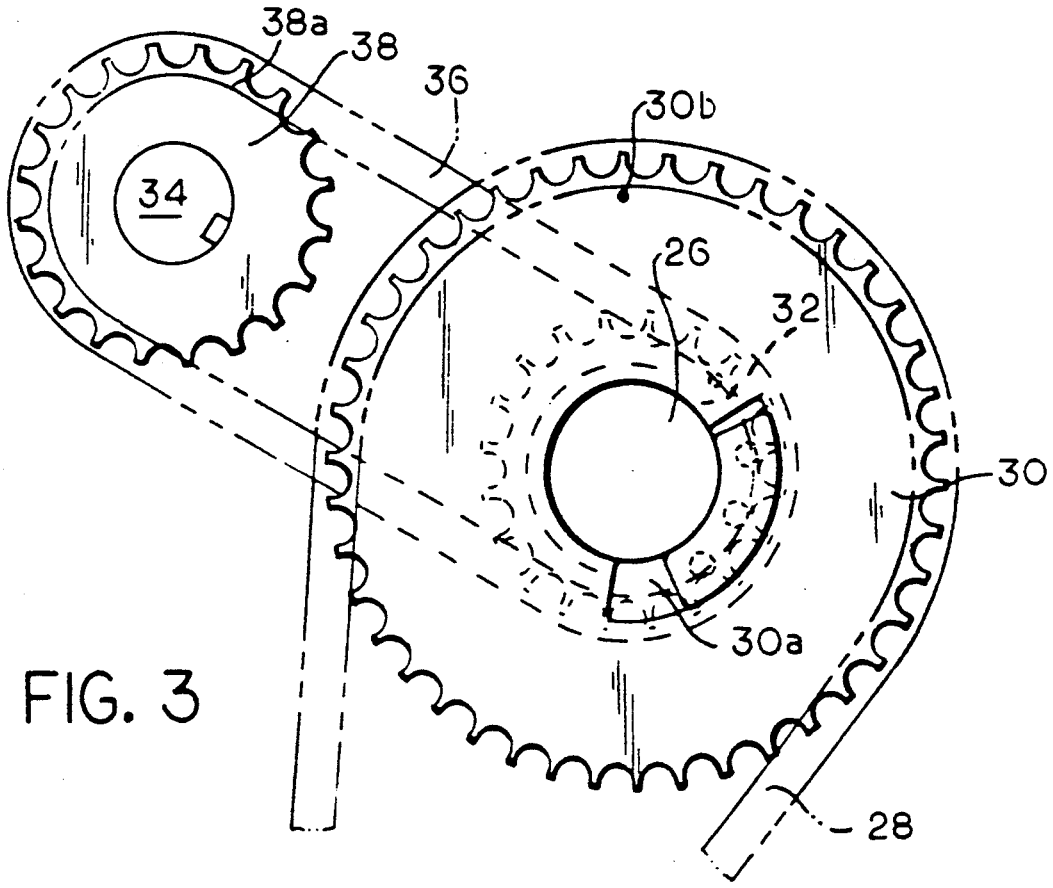
FIG. 3 is a fragmentary view taken on line 3—3 of FIG. 6 with some of the structure being removed for the sake of clarity and being shown in the retarded position of the device.
Figure 5:
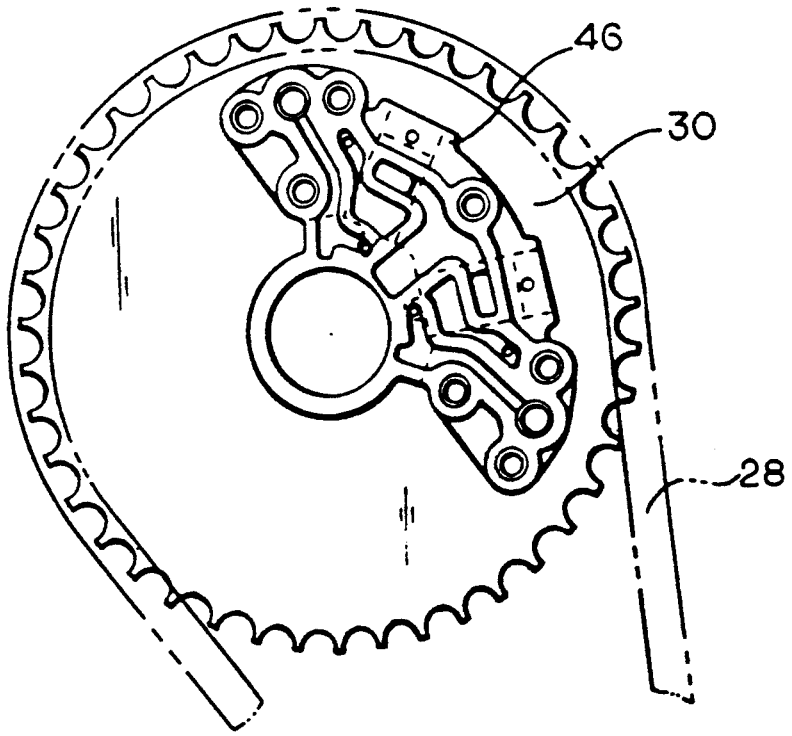
FIG. 5 is a fragmentary view showing the reverse side of some of the structure illustrated in FIG. 1.
Figure 4:
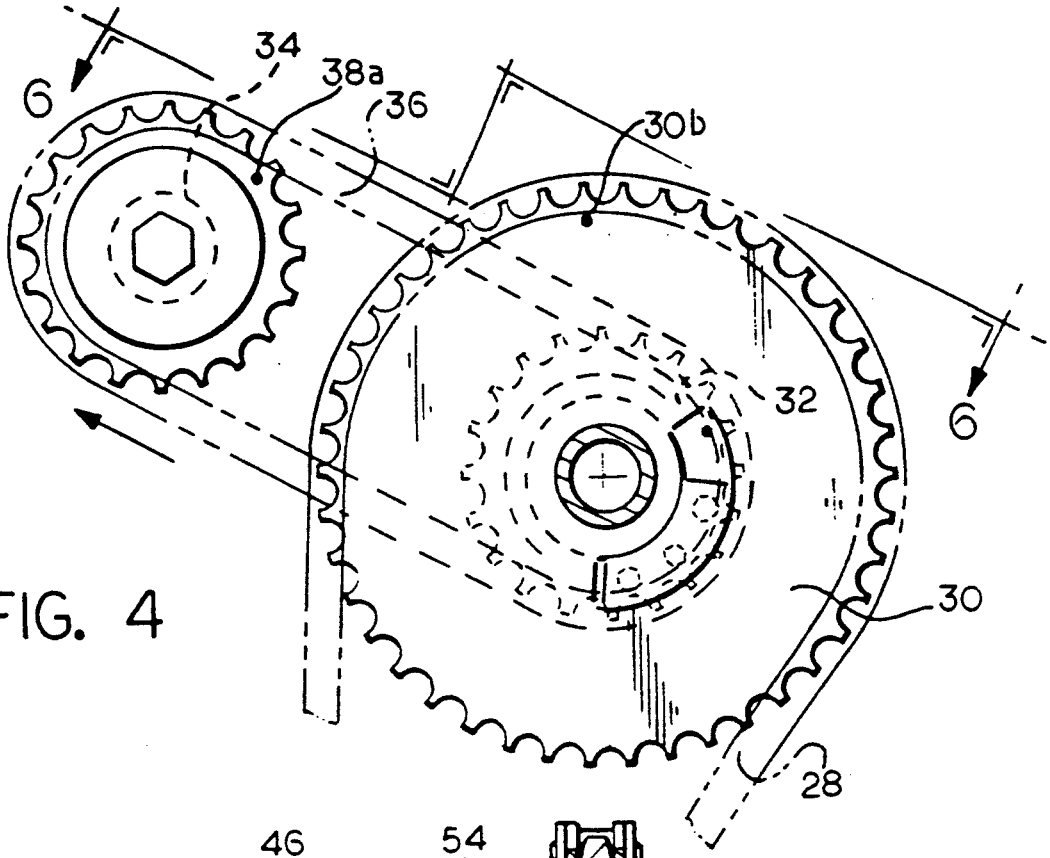
FIG. 4 is a fragmentary view similar to FIG. 3 showing the intake camshaft in an advanced position relative to the exhaust camshaft.
Figure 9:
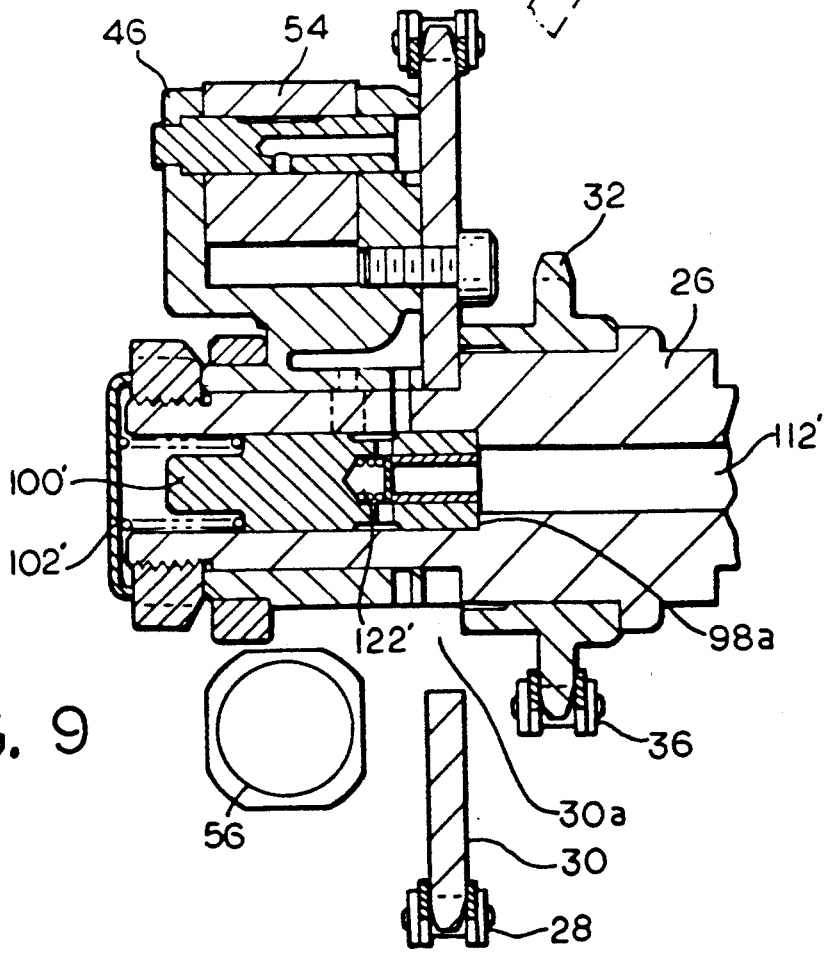
FIG. 9 is a sectional view taken on line 9—9 of FIG. 3.
Figure 7:
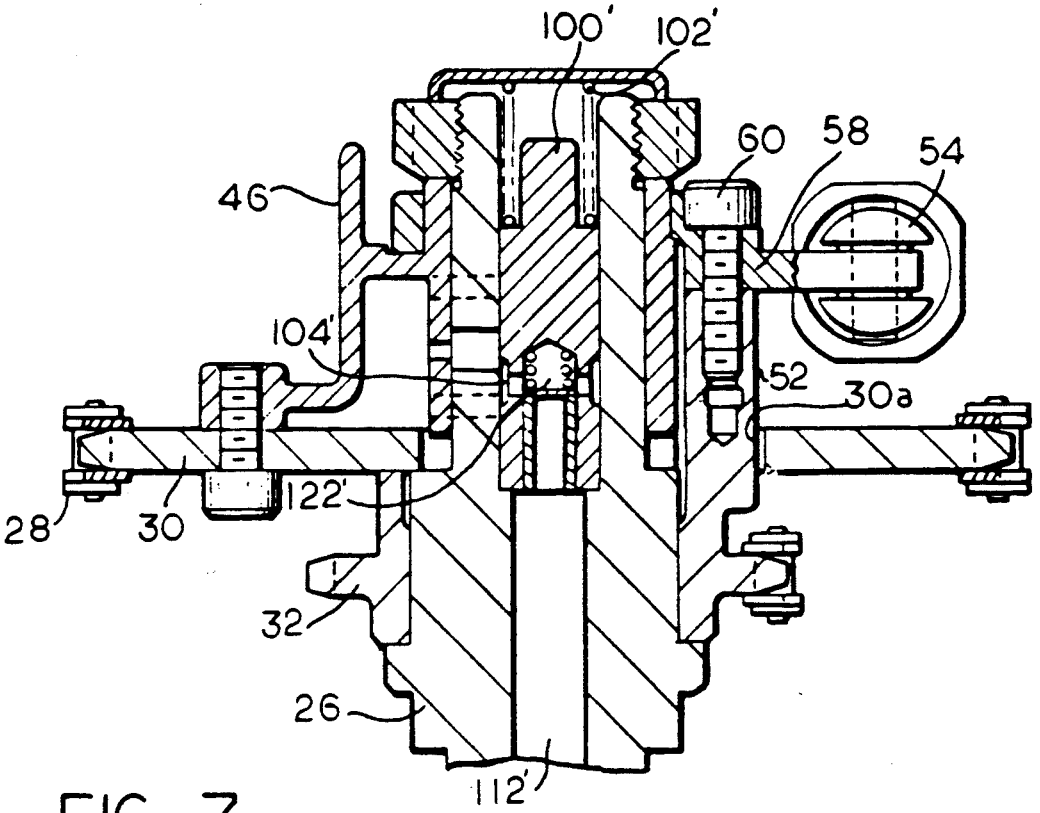
FIG. 7 is a fragmentary view taken on line 7—7 of FIG. 1.
Figure 8:
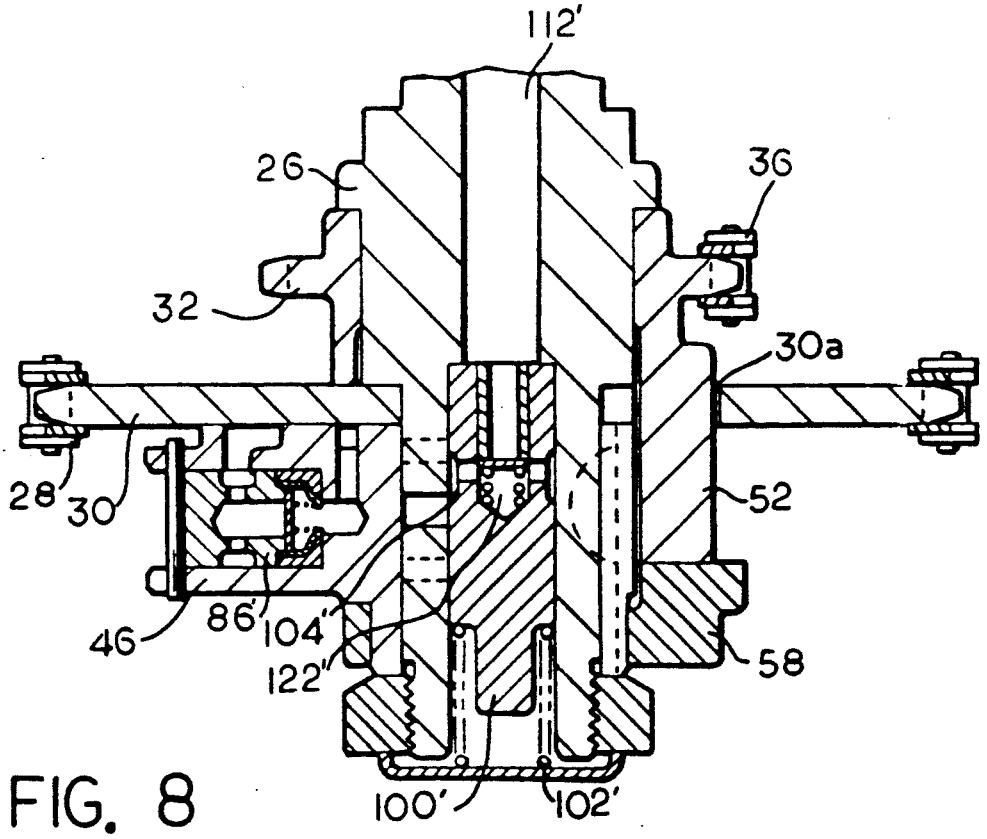
FIG. 8 is a sectional view taken on line 8—8 of FIG. 1.
Figure 10:
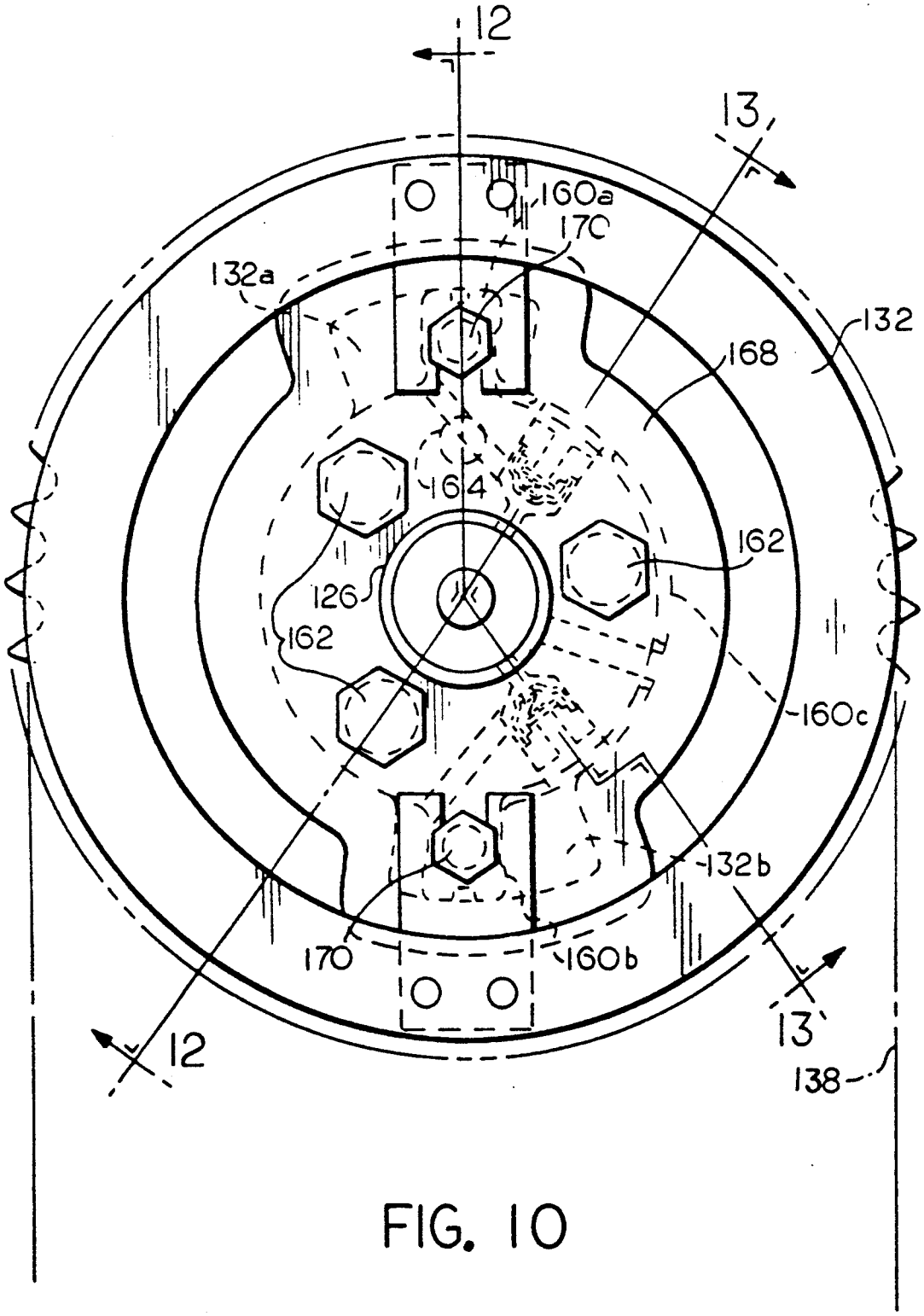
FIG. 10 is an end elevational view of a camshaft with an alternate embodiment of a conventional VCT system applied thereto.
Figure 11:
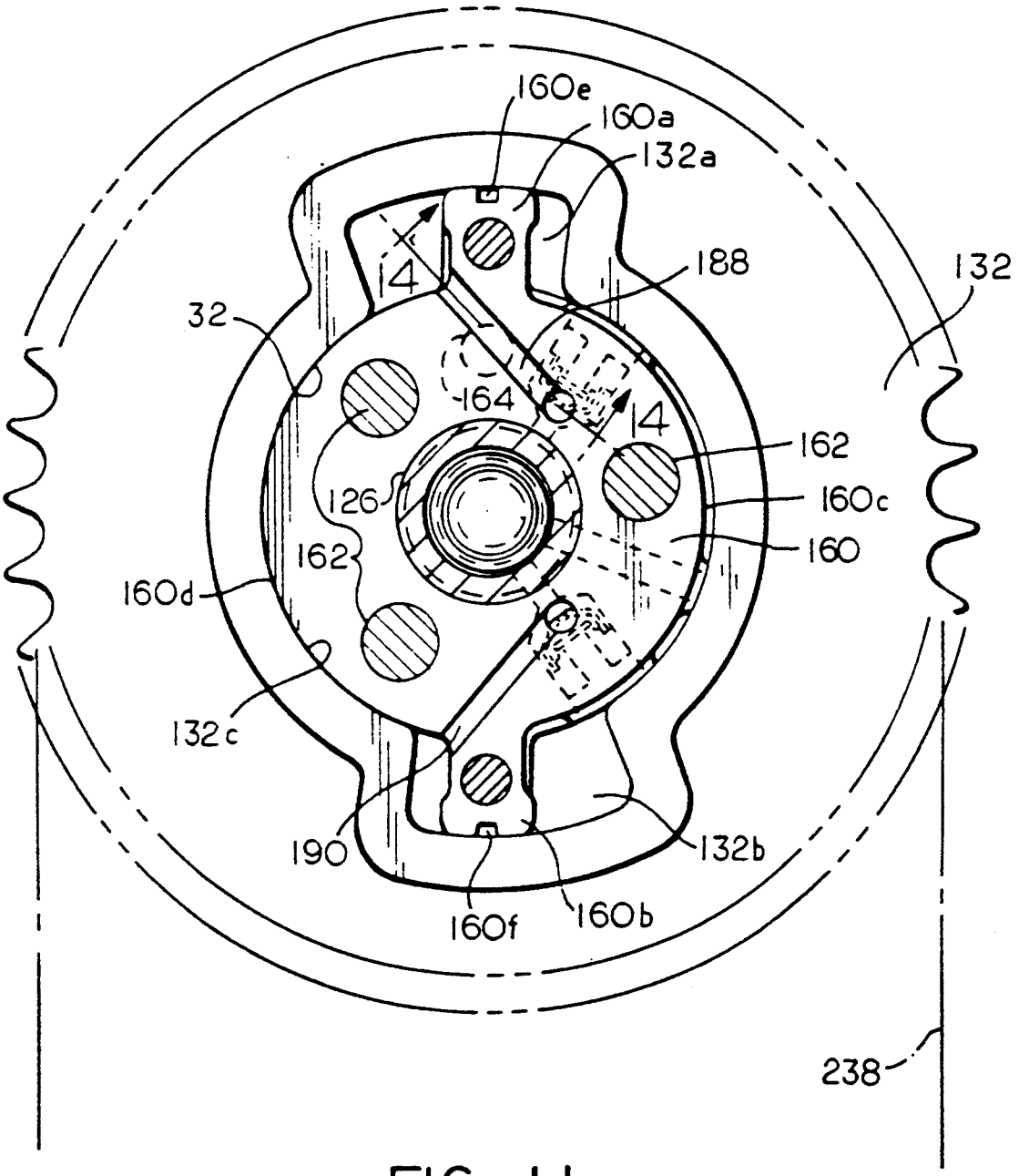
FIG. 11 is a view similar to FIG. 10 with a portion of the structure thereof removed to more clearly illustrate other portions thereof.
Figure 12:
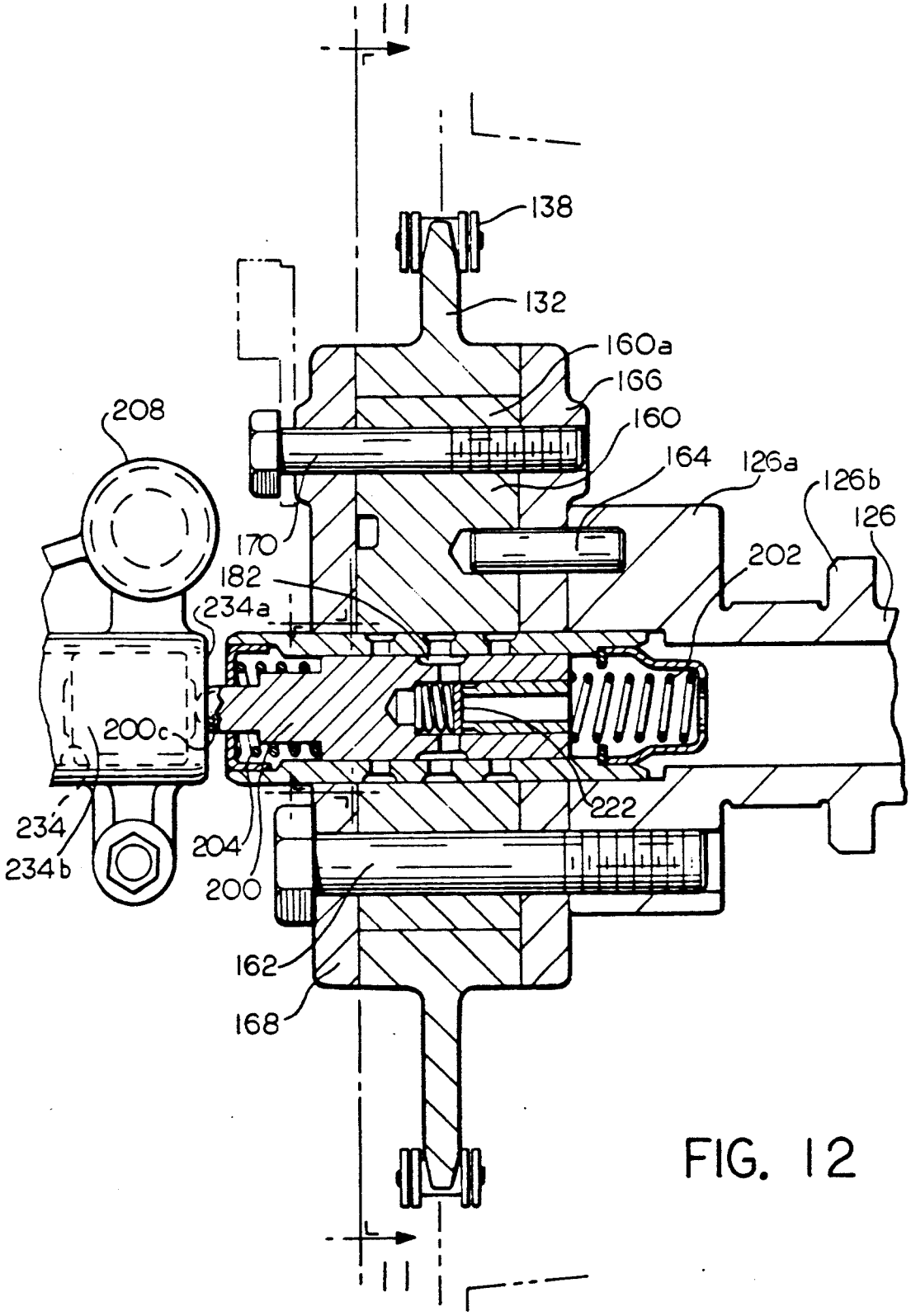
FIG. 12 is a sectional view taken on line 12—12 of FIG. 11.
Figure 13:
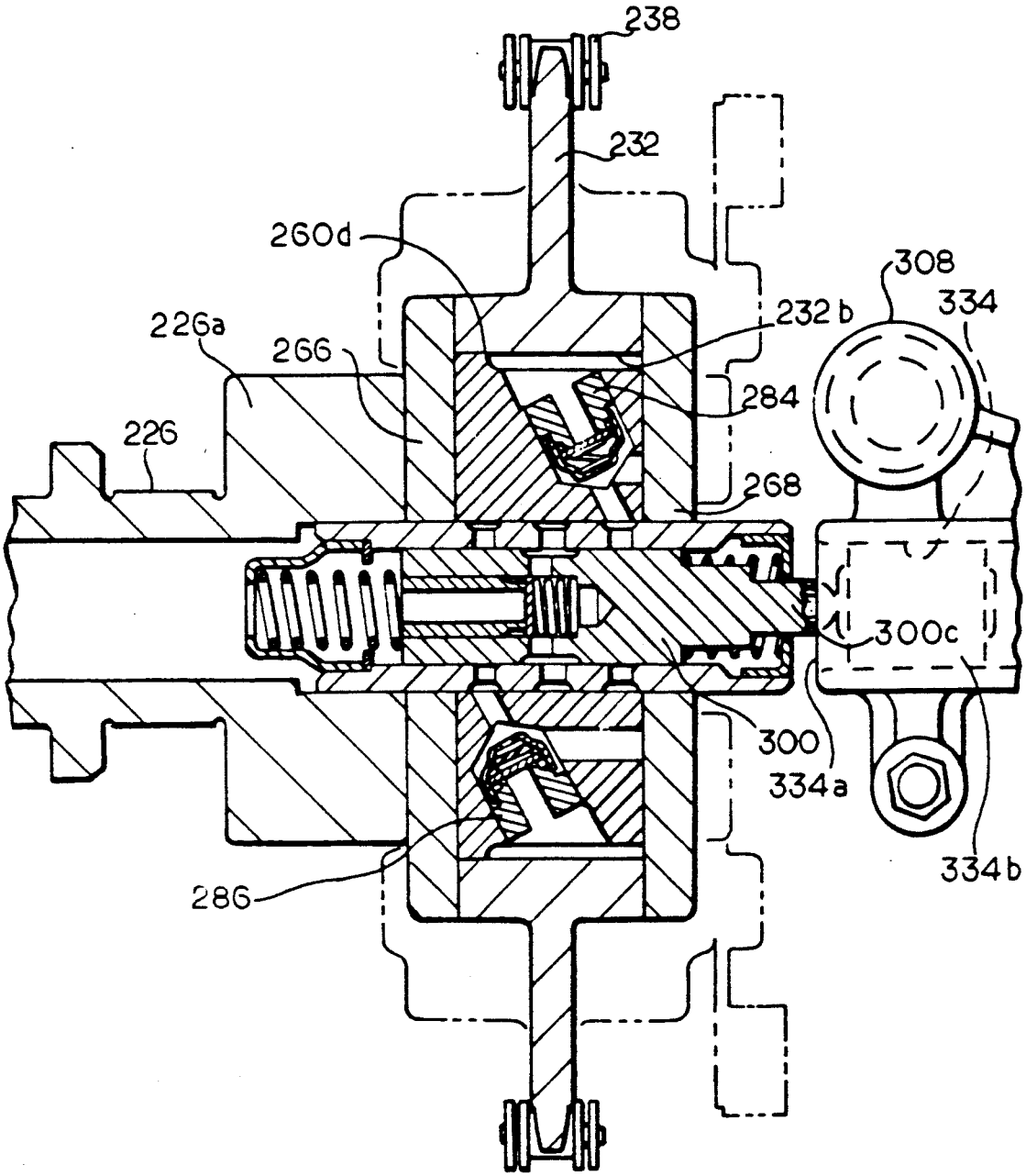
FIG. 13 is a sectional view taken on line 13—13 of FIG. 11.
Figure 15:
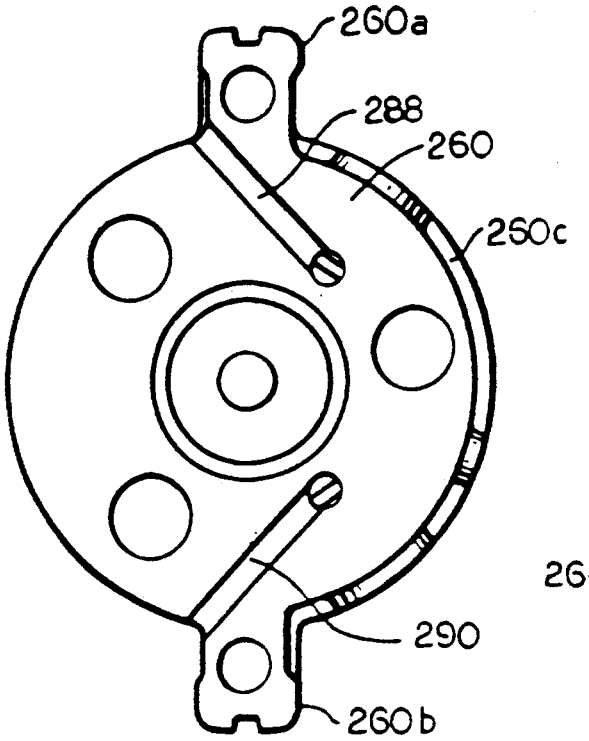
FIG. 15 is an end elevational view of an element of the variable camshaft timing system of FIGS. 10-14.
Figure 16:
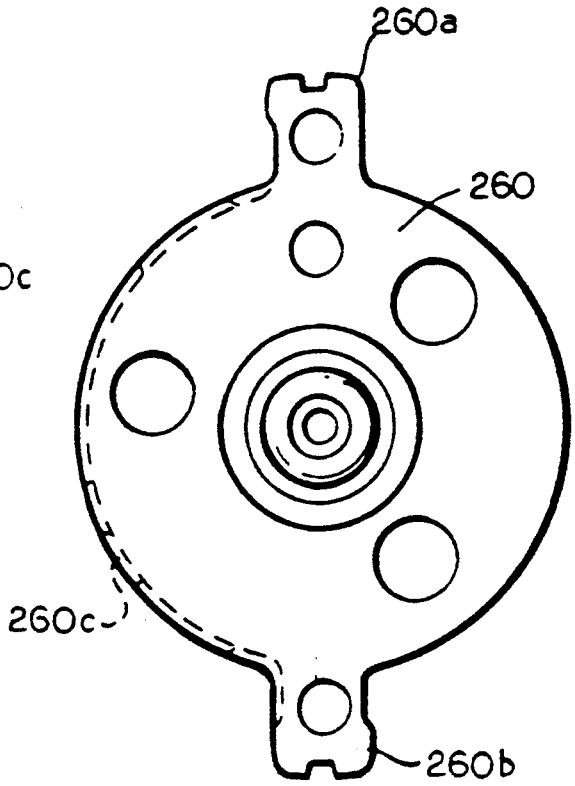
FIG. 16 is an elevational view of the element of FIG. 15 from the opposite end thereof.
Figure 14:
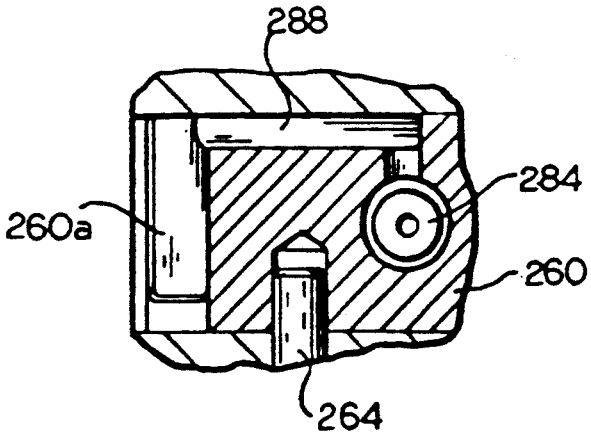
FIG. 14 is a sectional view taken on line 14—14 of FIG. 11.
Figure 17:
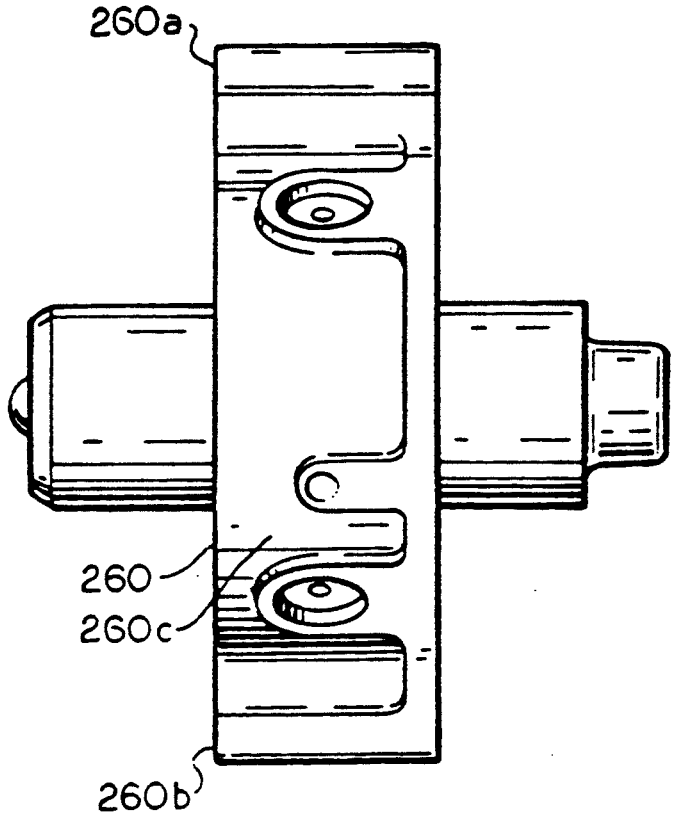
FIG. 17 is a side elevational view of the element of FIGS. 15 and 16.
Figure 18:
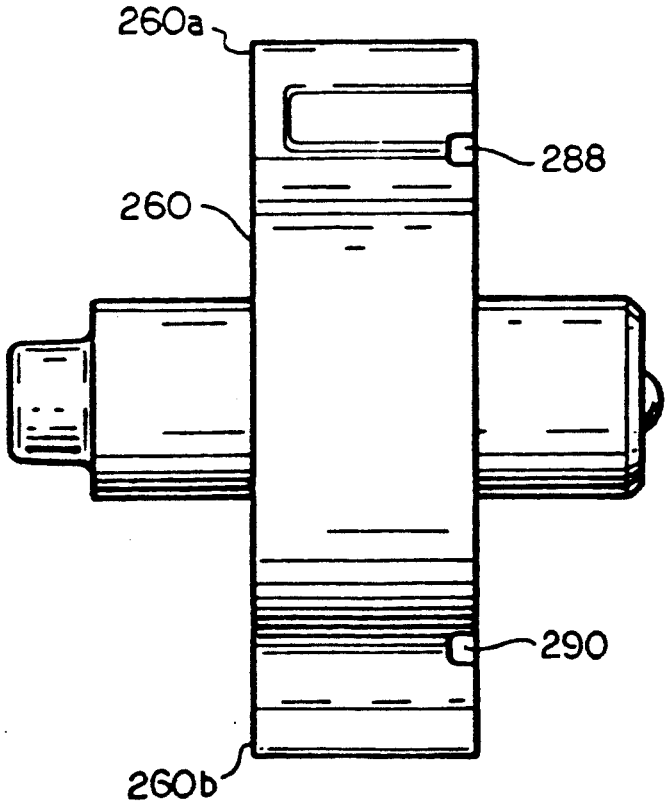
FIG. 18 is an elevational view of the element of FIG. 17 from the opposite side thereof.

The camshaft 26 carries another sprocket, namely sprocket 32, FIG. 3, 4 and 6, journalled thereon to be oscillatable through a limited arc with respect thereto and to be otherwise rotatable with the camshaft 26. Rotation of the camshaft 26 is transmitted to an intake camshaft 34 by a chain 36 which is trained around the sprocket 32 and a sprocket 38 that is keyed to the intake camshaft 34. As shown, the sprockets 32 and 38 are equal in diameter to provide for equivalent rates of rotation between the camshaft 26 and the camshaft 34. The use of a belt in place of the chain 36 is also contemplated.

As is illustrated in FIG. 6, an end of each of the camshafts 26 and 34 is journalled for rotation in bearings 42 and 44, respectively, of the head 50, which is shown fragmentarily and which is bolted to an engine block, otherwise not shown, by bolts 48. The opposite ends of the camshafts 26 and 34, not shown, are similarly journalled for rotation in an opposite end, also not shown, of the head 50. The sprocket 38 is keyed to the camshaft 34 at a location of the camshaft 34 which is outwardly of the head 50. Similarly, the sprockets 32 and 30 are positioned, in series, on the camshaft 26 at locations outwardly of the head 50, the sprocket 32 being transversely aligned with the sprocket 38 and the sprocket 30 being positioned slightly outwardly of the sprocket 32, to be transversely aligned with the sprocket 24.

Figure 2:
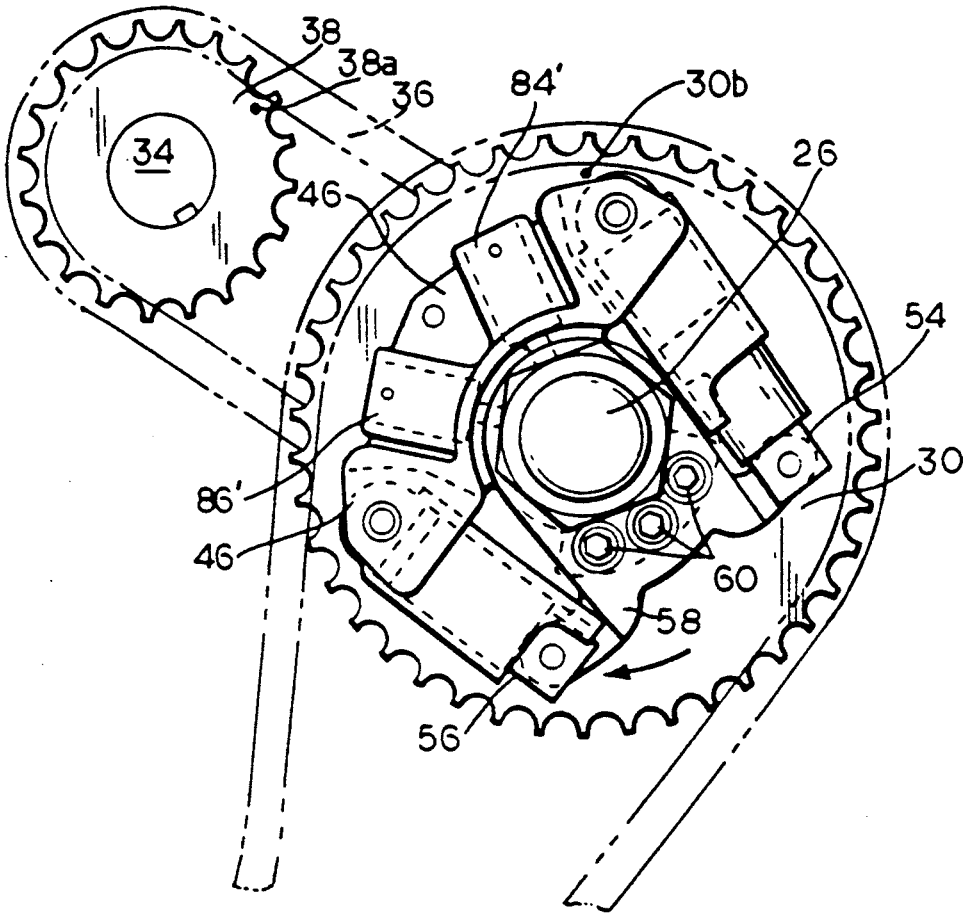
FIG. 2 is a fragmentary view similar to a portion of FIG. 1 showing the intake camshaft in an advanced position relative to the exhaust camshaft.

The sprocket 32 has an arcuate retainer 52 (FIGS. 7 and 8) as an integral part thereof, and the retainer 52 extends outwardly from the sprocket 32 through an arcuate opening 30a in the sprocket 30. The sprocket 30 has an arcuate hydraulic body 46 bolted thereto and the hydraulic body 46, which houses certain of the hydraulic components of the associated hydraulic control system, receives and pivotably supports the body end of each of a pair of oppositely acting, single acting hydraulic cylinders 54 and 56 which are positioned on opposite sides of the longitudinal axis of the camshaft 26. The piston ends of the cylinders 54 and 56 are pivotally attached to an arcuate bracket 58, and the bracket 58 is secured to the sprocket 32 by a plurality of threaded fasteners 60. Thus, by extending one of the cylinders 54 and 56 and by simultaneously retracting the other of the cylinders 54 and 56, the arcuate position of the sprocket 32 will be changed relative to the sprocket 30, either to advance the sprocket 32 if the cylinder 54 is extended and the cylinder 56 is retracted, which is the operating condition illustrated in FIGS. 2 and 4, or to retard the sprocket 32 relative to the sprocket 30 if the cylinder 56 is extended and the cylinder 54 is retracted, which is the operating condition illustrated in FIGS. 1, 3, 7 and 8. In either case, the retarding or advancing of the position of the sprocket 32 relative to the position of the sprocket 30, which is selectively permitted or prevented in reaction to the direction of torque in the camshaft 26, as explained in the aforesaid U.S. Pat. No. 5,002,023, will advance or retard the position of the camshaft 34 relative to the position of the camshaft 26 by virtue of the chain drive connection provided by the chain 36 between the sprocket 32, which is journalled for limited relative arcuate movement on the camshaft 26, and the sprocket 38, which is keyed to the camshaft 34. This relationship can be seen in the drawing by comparing the relative position of a timing mark 30b on the sprocket 30 and a timing mark 38a on the sprocket 38 in the retard position of the camshaft 34, as is shown in FIGS. 1 and 3, to their relative positions in the advanced position of the camshaft 34, as is shown in FIGS. 2 and 4.

FIGS. 10–19 illustrate an embodiment of a vane-type VCT system with a conventional DPCS, as disclosed by the aforementioned U.S. Patents previously incorporated by reference. A housing in the form of a sprocket 132 is oscillatingly journalled on a camshaft 126. The camshaft 126 may be considered to be the only camshaft of a single camshaft engine, either of the overhead camshaft type or the in block camshaft type. Alternatively, the camshaft 126 may be considered to be either the intake valve operating camshaft or the exhaust valve operating camshaft of a dual camshaft engine. In any case, the sprocket 132 and the camshaft 126 are rotatable together, and are caused to rotate by the application of torque to the sprocket 132 by an endless roller chain 138, shown fragmentarily, which is trained around the sprocket 132 and also around a crankshaft, not shown. As will be hereinafter described in greater detail, the sprocket 132 is oscillatingly journalled on the camshaft 126 so that it is oscillatable at least through a limited arc with respect to the camshaft 126 during the rotation of the camshaft, an action which will adjust the phase of the camshaft 126 relative to the crankshaft.

An annular pumping vane 160 is fixedly positioned on the camshaft 126, the vane 160 having a diametrically opposed pair of radially outwardly projecting lobes 160a, 160b and being attached to an enlarged end portion 126a of the camshaft 126 by bolts 162 which pass through the vane 160 into the end portion 126a. In that regard, the camshaft 126 is also provided with a thrust shoulder 126b to permit the camshaft to be accurately positioned relative to an associated engine block, not shown. The pumping vane 160 is also precisely positioned relative to the end portion 126a by a dowel pin 164 which extends therebetween. The lobes 160a, 160b are received in radially outwardly projecting recesses 132a, 132b, respectively, of the sprocket 132, the circumferential extent of each of the recesses 132a, 132b being somewhat greater than the circumferential extent of the vane lobe 160a, 160b which is received in such recess to permit limited oscillating movement of the sprocket 132 relative to the vane 160. The recesses 132a, 132b are closed around the lobes 160a, 160b, respectively, by spaced apart, transversely extending annular plates 166, 168 which are fixed relative to the vane 160, and, thus, relative to the camshaft 126, by bolts 170 which extend from one to the other through the same lobe, 160a, 160b. Further, the inside diameter 132c of the sprocket 132 is sealed with respect to the outside diameter of the portion 160d of the vane 160 which is between the lobes 160a, 160b, and the tips of the lobes 160a, 160b of the vane 160 are provided with seal receiving slots 160e, 160f, respectively. Thus each of the recesses 132a, 132b of the sprocket 132 is capable of sustaining hydraulic pressure, and within each recess 132a, 132b, the portion on each side of the lobe 160a, 160b, respectively, is capable of sustaining hydraulic pressure.

Figure 19:
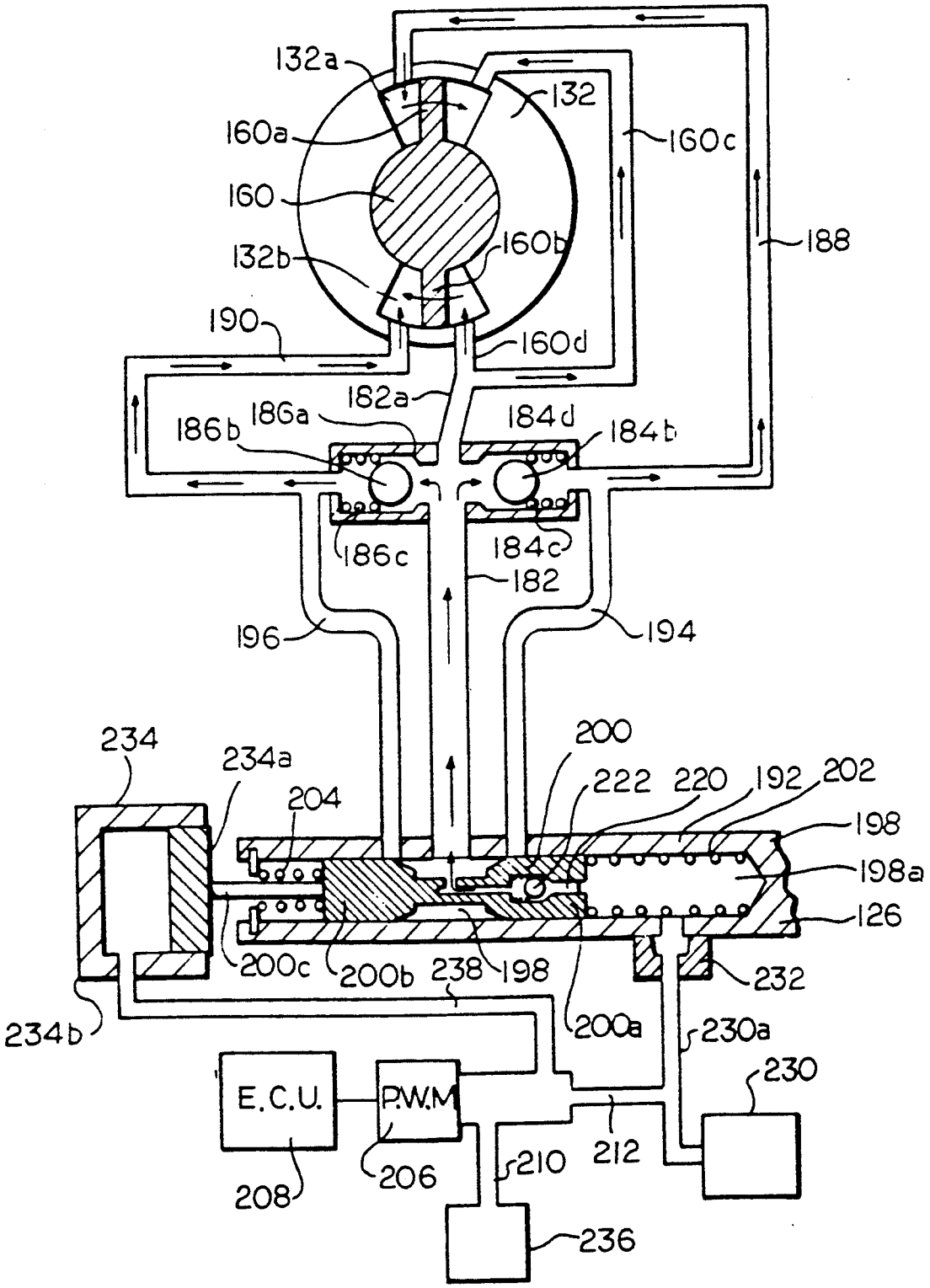
FIG. 19 is a simplified schematic view of the conventional VCT arrangement of FIGS. 10-18.

The functioning of the structure of the embodiment of FIGS. 10–18, as thus far described, may be understood by reference to FIG. 19. It also is to be understood, however, that the hydraulic control system of FIG. 19 is also applicable to an opposed hydraulic cylinder VCT system corresponding to the embodiment of FIGS. 1–9, as well as to a vane type VCT system corresponding to the embodiment of FIGS. 10–18.

In any case, hydraulic fluid, illustratively in the form of engine lubricating oil, flows into the recesses 132a, 132b by way of a common inlet line 182. The inlet line 182 terminates at a juncture between opposed check valves 184 and 186 which are connected to the recesses 132a, 132b, respectively, by branch lines 188, 190, respectively. The check valves 184, 186 have annular seats 184a, 186a, respectively, to permit the flow of hydraulic fluid through the check valves 184, 186 into the recesses 432a, 432b, respectively. The flow of hydraulic fluid through the check valves 184, 186 is blocked by floating balls 184b, 186b, respectively, which are resiliently urged against the seats 184a, 186a, respectively, by springs 184c, 186c, respectively. The check valves 184, 186, thus, permit the initial filling of the recesses 132a, 132b and provide for a continuous supply of make-up hydraulic fluid to compensate for leakage therefrom. Hydraulic fluid enters the line 182 by way of a spool valve 192, best shown in FIG. 19, which is incorporated within the camshaft 126, and hydraulic fluid is returned to the spool valve 192 from the recesses 132a, 132b by return lines 194, 196, respectively.

Figure 20:
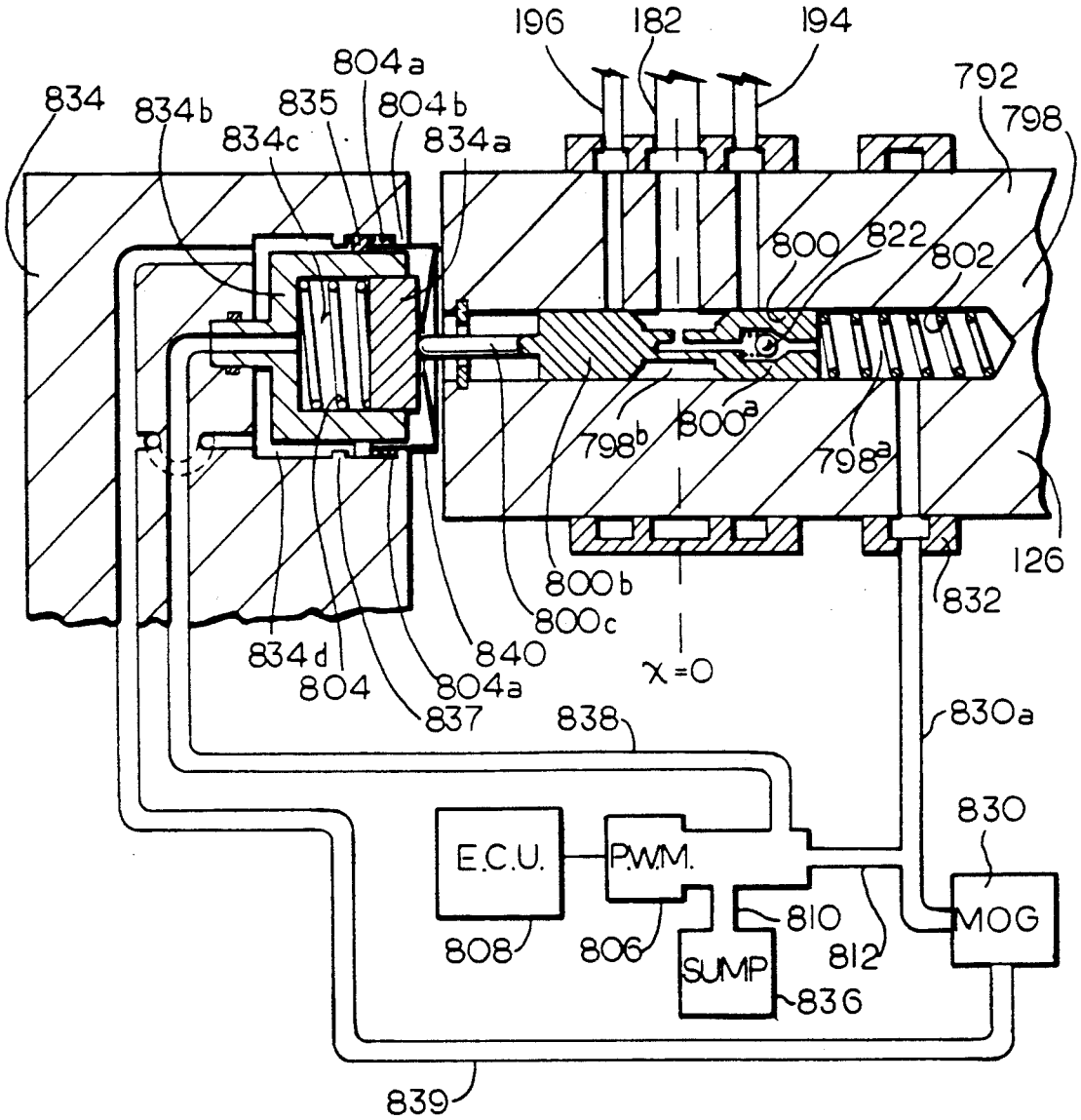
FIG. 20 is a schematic view, similar to FIG. 19, of the present invention with the spool in the normal or unbiased position.
Figure 21:
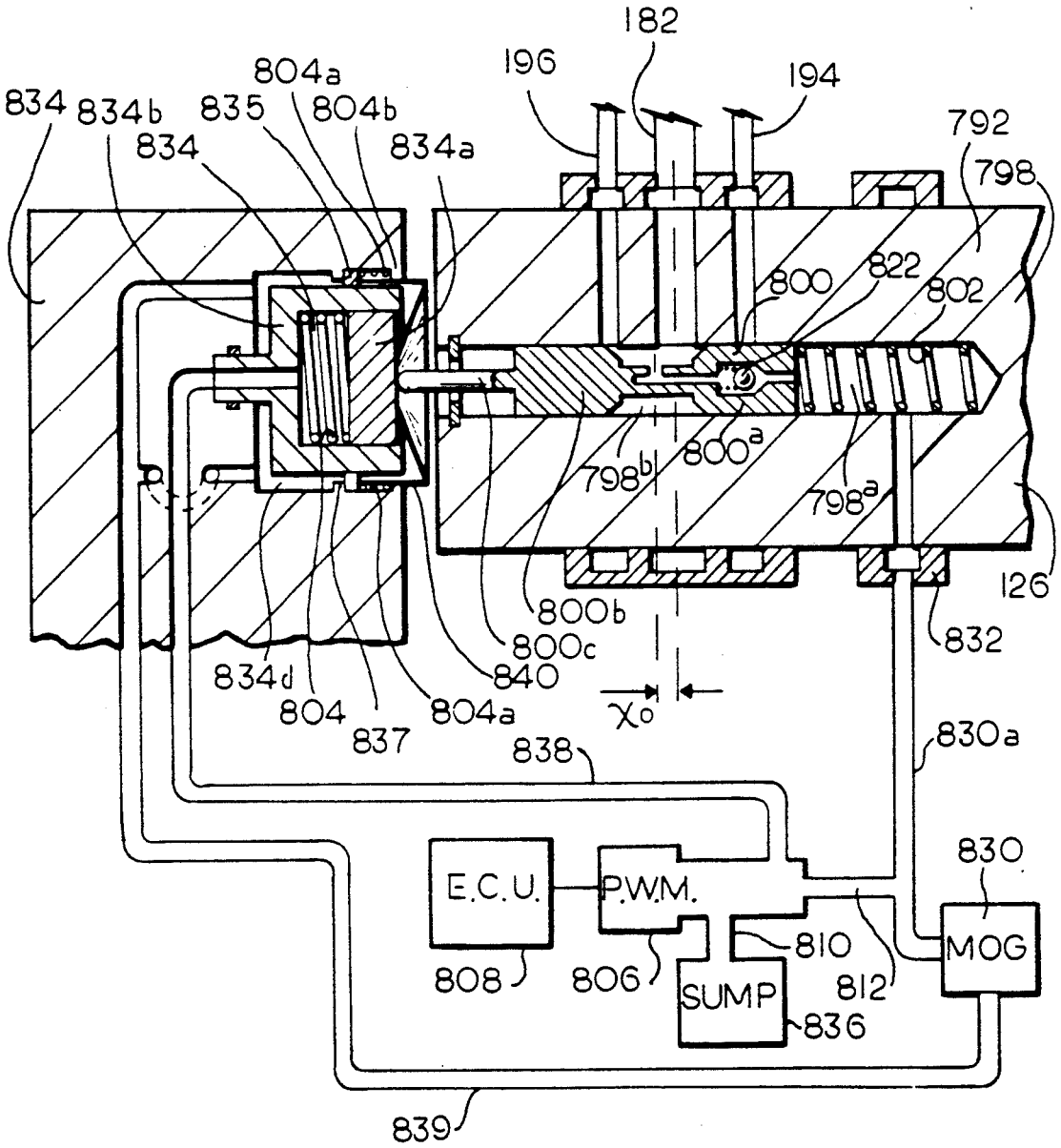
FIG. 21 is a schematic view of the present invention with the spool in the full advance or biased position.

FIGS. 20 and 21 illustrate one embodiment of the present invention in the normal and biased operational modes, respectively. The spool valve 792 is made up of a cylindrical member 798 and a spool 800 which is slidable to and from within the member 798. The spool 800 has cylindrical lands 800a and 800b on opposed ends thereof, and the lands 800a and 800b, which fit snugly within the member 798, are positioned so that the land 800*b* will block the exit of hydraulic fluid from the return line 196, or the land 800*a* will block the exit of hydraulic fluid from the return line 194, or both lands 800*a* and 800*b* will block the exit of hydraulic fluid from both the return lines 194 and 196. The third position, where both return lines 194 and 196 are blocked, the camshaft 126 is being maintained in a selected intermediate position relative to the crankshaft—in other words the centerline of spool 800 aligns with the centerline of inlet line 182 and thus x=0 (as shown in FIG. 20).

FIG. 20 illustrates the present invention under normal operating conditions, i.e. when supply pressure $P_s$ is at its full value. The position of spool 800 within member 798 is influenced by an opposed pair of springs, first spring 802 and second spring 804. Spring 802 is contained within spool valve body cavity 798*a* and acts on land 800*a*. Spring 804 is contained within hydraulic cylinder cavity 834*c* and acts upon hydraulic piston 834*a*. The outer surface of hydraulic piston 834*a* bears against extension 800*c* of spool 800. Thus, spring 802 resiliently urges spool 800 to the left, in the orientation illustrated in FIG. 20, and spring 804 resiliently urges hydraulic piston 834*a* to the right in such orientation. The position of spool 800 within member 798 is further influenced by a supply of pressurized hydraulic fluid within portion 798*a* of member 798, on the outside of land 800*a*, which urges spool 800 to the left. Portion 798*a* of member 798 receives its pressurized fluid (engine oil) directly from main oil gallery ("MOG") 830 of the engine by way of conduit 830*a* at supply pressure $P_s$. MOG 830 also supplies engine oil to outer cavity 834*d* surrounding hydraulic cylinder housing 834*b*. Another purpose of the engine oil is to lubricate bearing 832 in which camshaft 126 of the engine rotates.

The control of the position of spool 800 within member 798 is in response to hydraulic pressure $P_c$ within hydraulic cylinder 834*c* whose piston 834*a* bears against extension 800*c* of spool 800. Cross-sectional area A of piston 834*a* is greater than cross-sectional area B of the end of spool 800 which is exposed to supply pressure $P_s$ within portion 798*a*, and is preferably twice as great. Thus, the hydraulic pressures which act in opposite directions on spool 800 will be in balance when the pressure $P_c$ within the cylinder 834*c* is one-half that of the pressure $P_s$ within portion 798*a*, assuming that cross-sectional area A of piston 834*a* is twice that of the end of land 800*a* of spool 800. This facilitates the control of the position of spool 800 in that, if springs 802 and 804 are balanced, spool 800 will remain in its null or centered position (x=O), as illustrated in FIG. 20, with less than full engine oil pressure in cylinder 834*c*, thus allowing spool 800 to be moved in either direction by increasing or decreasing the pressure in cylinder 834*c*, as the case may be. Further, the operation of springs 802 and 804 will ensure the return of spool 800 to its null or centered position when the hydraulic loads on the ends of lands 800*a* and 800*b* come into balance. While the use of springs 802 and 804 is preferred in the centering of spool 800 within member 798, it is also contemplated that electromagnetic or electro-optical centering means can be employed, if desired.

The static position of spool 800 in its normal position can be determined as follows:

$$x = \frac{(AP_C - BP_S)}{K_S}$$

where:

x=position of spool with regard to the centerline of inlet line 182;

A=cross-sectional area of hydraulic piston 834*a*;

$P_c$=control pressure;

$P_s$=supply pressure;

B=cross-sectional area of land 800*a*; and $K_s$=the sum of the rates of the springs 802 and 804.

If $P_c$ is controlled by a three-way solenoid valve such that cross-sectional area B is half that of cross-sectional are A, then null is achieved at 50% duty cycle and equal control ranges are available above and below null. The advantage of utilizing a DPCS such as this is that the null duty cycle remains constant while the oil pressure may undergo significant variation.

The pressure within cylinder 834*c* is controlled by solenoid 806, preferably of the pulse width modulated type ("PWM"), in response to a control signal from electronic engine control unit ("ECU") 808, shown schematically, which may be of conventional construction. With spool 800 in its null position when the pressure in cylinder 834*c* is equal to one-half the pressure in spool valve cavity 798*a*, as heretofore described, the on-off pulses of solenoid 806 will be of equal duration; by increasing or decreasing the "on" duration relative to the "off" duration, the pressure $P_c$ in cylinder 834*c* will be increased or decreased relative to such one-half level, thereby moving spool 800 to the right or to the left, respectively. Solenoid 806 receives engine oil from MOG 830 through inlet line 812 and selectively delivers engine oil from such source to cylinder 834*b* through supply line 838. Excess oil from solenoid 806 is drained to sump 836 by way of conduit 810. Cylinder 834*b* may be mounted at an exposed end of camshaft 126 so that piston 834*a* bears against exposed free end 800*c* of spool 800. In this case, solenoid 808 is preferably mounted in housing 834*b* which also houses the cylinder 834*a*.

Hydraulic cylinder housing 834*b* is surrounded by control body 834, thus creating cavity 834*d* between control body 834 and cylinder housing wall 834*b*. Cavity 834*d* is sealed at the end near spool 800, that is, the forward end, by biasing ring 835. The rearward end of cavity 834*d* is connected hydraulically to the lubricating oil source, i.e. MOG 830, via conduit 839, thus experiencing supply pressure $P_s$ therein. A third spring 804*a* is positioned between the forward end of biasing ring 835 and forward spring stop 804*b*. Third spring 804*a* exerts a rearward force on biasing ring 835, the rearward travel of biasing ring 835 being limited by biasing ring stop 837. Attached to biasing ring 835 is biasing bracket 840 which extends forward of biasing ring 835 and beyond the forward end of hydraulic piston 834*a*. Biasing ring/biasing bracket combination 835/840 is free to slide to and fro, independently of the movement of hydraulic piston 834*a* in the same directions.

In the normal mode of operation as illustrated in FIG. 20, the present invention operates much like the VCT system disclosed in U.S. patent application 07/942,426. Supply pressure Ps is greater than some minimum pressure $P_{min}$. Spring 804 counterbalances the force exerted by spring 802 so that spool 800 is at null with zero pressure. As long as $P_s$ in cavity 834*d* acting on biasing ring 835 is sufficient to compress spring 804 and keep biasing bracket 840 clear of hydraulic piston 834*a*, the DPCS maintains an unbiased, pressure-independent null condition.

During the biased mode of operation, as illustrated in FIG. 21, a low supply pressure condition will result in spool 800 being forced to the extreme advance position, as illustrated by $x_0$. Because the supply pressure is less than $P_{min}$ the pressure required to compress third spring 804a, third spring 804a expands, driving biasing ring/biasing bracket combination 835/840 in the rearward direction until the movement of biasing ring 835 is checked by rear ring stop 837. In doing so, biasing bracket 840 captures piston 834a, carrying it to the left. This rearward movement of hydraulic piston 834a allows first spring 802 to force spool 800 to its full advance position, as shown in FIG. 21.

Figure 22:
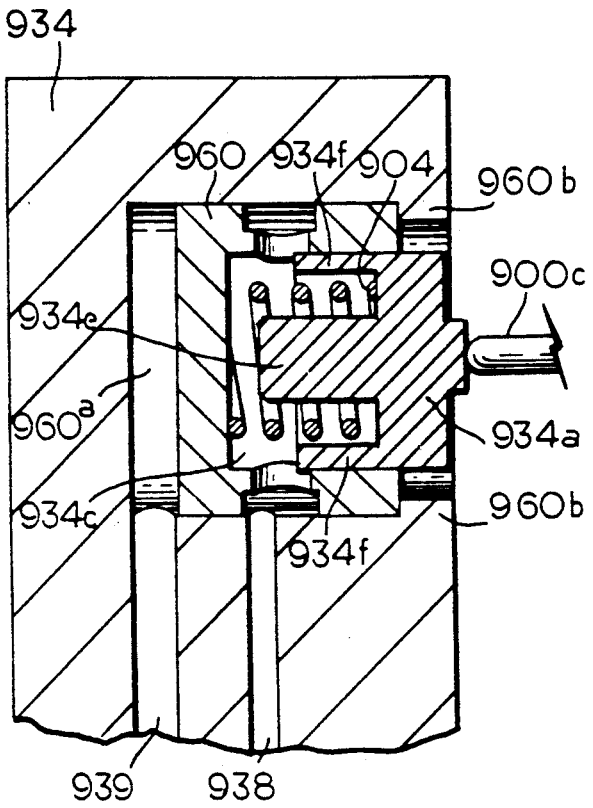
FIG. 22 is a partial schematic view of an alternate embodiment of the present invention with the spool (not shown) in the normal or unbiased position, showing only the modified hydraulic piston configuration used for biasing; and, FIG. 23 is a partial schematic view, corresponding to FIG. 22, of the alternate embodiment, but with the spool (not shown) in the full advance or biased position, showing only the modified hydraulic piston configuration used for biasing.
Figure 23:
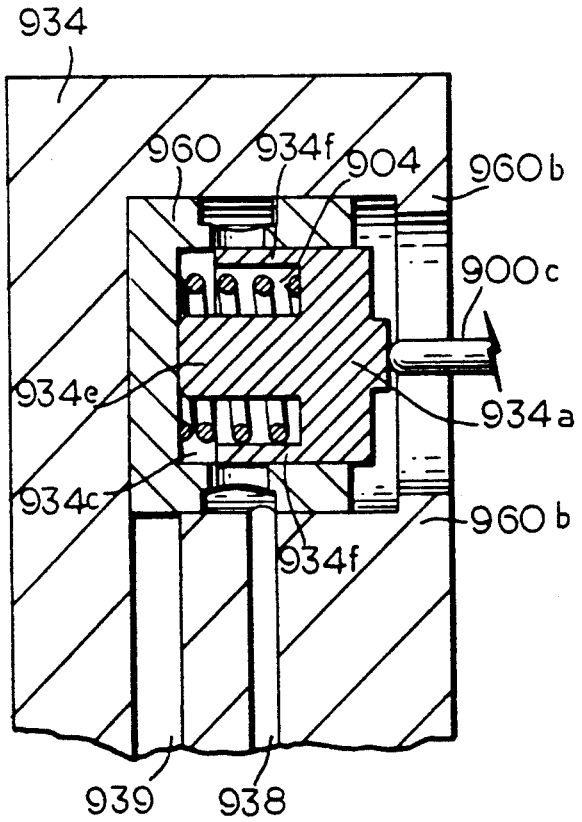

An alternate embodiment of the present invention is illustrated in FIGS. 22 and 23. Utilizing the same principles as described above, a "nested piston" configuration is used to bias the DPCS at low pressures while maintaining unbiased operation at normal operating pressures. Primary piston 934a is nested within biasing piston 960. Primary piston 934a has cylindrical axial projection 934f of uniform length, and cylindrical center projection 934e which is longer in length than axial projection 934f, as shown in FIGS. 22 and 23. Spring 904 is coiled around center projection 934e and bounded at the forward by front wall of primary piston 934a and at the rearward end by the rear wall of biasing piston 960. When the supply pressure is zero, then $P_s=O$ in cavity 960a located behind biasing piston 960. That low pressure condition allows first spring (not shown in FIGS. 22 and 23) to force spool (not shown) and spool extension 900c to the left, causing primary piston 934a to move to the left. Center projection 934e of primary piston 934a exerts a force against the rear wall of biasing piston 960 which also moves to the left. Biasing piston 960 ultimately comes to rest against control body 934, leaving spool (not shown) in the full advance, or leftmost, position. When $P_s$ reaches some minimum pressure $P_{min}$, it overcomes the resistance of first spring (not shown) and biasing piston 960 is forced to the right until it comes to rest against biasing piston stop 960b. At the same time, $P_c$ inside cavity 934c has forced primary piston 934a to the right so that center projection 934e is no longer resting against the rear wall of biasing piston 960. In this position, primary piston 934a is allowed to move freely inside biasing piston cylinder 960c. The force of first spring (not shown) and second spring 904 counteract each other and movement of primary piston 934a is then independent of biasing piston 960 and is solely controlled by the variations in $P_c$ supplied by PWM solenoid (not shown), which is normal (unbiased) DPCS operation.

Alternatively, biasing piston stop 960b may be mounted on the end of rotating camshaft (not shown), in which spool (not shown) is located. The length of axial projection 934f of biasing piston 960 is then extended so that it could reach stop 960b at its new location. The advantage of relocating biasing piston stop 960b is that it desensitizes the null position of the spool 900 (during normal unbiased operation) to inexact positioning between control body 934 and valve sleeve 798.

By using imbalances between oppositely acting hydraulic loads from a common hydraulic source on the opposed ends of the spool 800 to move it in one direction or another, as opposed to using imbalances between an hydraulic load on one end and a mechanical load on an opposed end, the control system of FIGS. 19-23 is capable of operating independently of variations in the viscosity or pressure of the hydraulic system. Thus, it is not necessary to vary the duty cycle of the solenoid 806 to maintain the spool 800 in any given position, for example, in its centered or null position, as the viscosity or pressure of the hydraulic fluid changes during the operation of the system. In that regard, it is to be understood that the centered or null position of the spool 800 is the position where no change in camshaft to crankshaft phase angle is occurring, and it is important to be able to rapidly and reliably position the spool 800 in its null position for proper operation of a VCT system.

The remaining portion of the system utilizes conventional DPCS technology, as shown in FIGS. 1-19. Make-up oil for the recesses 132a, 132b of the sprocket 132 to compensate for leakage therefrom is provided by way of a small, internal passage 220 within the spool 200, from the passage 198a to an annular space 198b of the cylindrical member 198, from which it can flow into the inlet line 182. A check valve 222 is positioned within the passage 220 to block the flow of oil from the annular space 198b to the portion 198a of the cylindrical member 198.

The vane 160 is alternatingly urged in clockwise and counterclockwise directions by the torque pulsations in the camshaft 126 and these torque pulsations tend to oscillate the vane 160, and, thus, the camshaft 126, relative to the sprocket 132. However, in the FIG. 19 position of the spool 200 within the cylindrical member 198, such oscillation is prevented by the hydraulic fluid within the recesses 132a, 132b of the sprocket 132 on opposite sides of the lobes 160a, 160b, respectively, of the vane 160, because no hydraulic fluid can leave either of the recesses 132a, 132b, since both return lines 194, 196 are blocked by the position of the spool 200, in the FIG. 19 condition of the system. If, for example, it is desired to permit the camshaft 126 and vane 160 to move in a counterclockwise direction with respect to the sprocket 132, it is only necessary to increase the pressure within the cylinder 234 to a level greater than one-half that in the portion 198a of the cylindrical member. This will urge the spool 200 to the right and thereby unblock the return line 194. In this condition of the apparatus, counterclockwise torque pulsations in the camshaft 126 will pump fluid out of the portion of the recess 132a and allow the lobe 162a of vane 160 to move into the portion of the recess which has been emptied of hydraulic fluid. However, reverse movement of the vane will not occur as the torque pulsations in the camshaft become oppositely directed unless and until the spool 200 moves to the left, because of the blockage of fluid flow through the return line 196 by the land 200b of the spool 200. While illustrated as a separate closed passage in FIG. 19, the periphery of the vane 160 has an open oil passage slot, element 160c in FIGS. 10, 11, 15, 16 and 17, which permits the transfer of oil between the portion of the recess 132a on the right side of the lobe 160a and the portion of the recess 132b on the right side of the lobe 160b, which are the non-active sides of the lobes 160a, 160b; thus, counterclockwise movement of the vane 160 relative to the sprocket 132 will occur when flow is permitted through return line 194 and clockwise movement will occur when flow is permitted through return line 196.

Further, the passage 182 is provided with an extension 182a to the non-active side of one of the lobes 160a, 160b, shown as the lobe 160b, to permit a continuous supply of make-up oil to the non-active sides of the lobes 160a, 160b for better rotational balance, improved damping of vane motion, and improved lubrication of the bearing surfaces of the vane 160. It is to be noted that the supply of make-up oil in this manner avoids the need to route the make-up oil through the solenoid 206. Thus, the flow of make-up oil does not affect, and is not affected by, the operation of the solenoid 206. Specifically make-up oil will continue to be provided to the lobes 160*a*, 160*b* in the event of a failure of the solenoid 206, and it reduces the oil flow rates that need to be handled by the solenoid 206.

The elements of the structure of FIGS. 10–18 which correspond to the elements of FIG. 19, as described above, are identified in FIGS. 10–18 by the reference numerals which were used in FIG. 19, it being noted that the check valves 184 and 186 are disc-type check valves in FIGS. 10–18 as opposed to the ball type check valves of FIG. 19. While disc-type check valves are preferred for the embodiment of FIGS. 10-18, it is to be understood that other types of check valves can also be used.

Although the best mode contemplated by the inventors for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. In a hydraulic system comprising a source of hydraulic fluid under pressure (830), a first hydraulic operator (160*a*), first conduit means (188) for delivering hydraulic fluid from the source to the first hydraulic operator, second conduit means (194) for exhausting hydraulic fluid from the first hydraulic operator, a second hydraulic operator (160*b*), third conduit means (190) for delivering hydraulic fluid from the source to the second hydraulic operator, fourth conduit means (196) for exhausting hydraulic fluid from the second hydraulic operator, and control means for controlling the exhausting of hydraulic fluid from the first hydraulic operator and the second hydraulic operator, said control means comprising:

a spool valve (792) in communication with said second conduit means and said fourth conduit means, said spool valve comprising a housing (798) and a valve member (800), said valve member being reciprocable within said housing and comprising first and second opposed ends and first and second spaced apart lands (800*a* and 800*b*) between said opposed ends, said first land being capable of blocking flow through said second conduit means in first and third positions of said valve member and permitting flow through said second conduit means in a second position of said valve member, said second land being capable of blocking flow through said fourth conduit means in said first and second positions of said valve member and permitting flow through said fourth conduit means in said third position of said valve member;

fifth conduit means (830*a*) for transmitting hydraulic pressure from the source to act on a first surface of said valve member at substantially the pressure of the source to urge the valve member in a given direction;

force imposing means imposing a load on said valve member to urge said valve member in an opposed direction, said force imposing means having a second surface with an area that is substantially greater than the area of said first surface;

sixth conduit means (838) for transmitting hydraulic pressure from the source to the force imposing means to act on said second surface of said force imposing means, said sixth conduit means comprising a control member (806) therein to controllably reduce the pressure of the source that acts on said second surface of said force imposing means;

centering means for centering said valve member in a fixed position relative to said housing when the hydraulic forces acting on said valve member are in balance; and, biasing means for forcing said valve member to its full advance position during a low pressure condition of operation.

2. A hydraulic system according to claim 1 wherein one of said first surface and said second surface is an end of said valve member, wherein said force imposing means comprises an hydraulic piston (234*a*), and wherein the other of said first surface and said second surface is a surface of said hydraulic piston.

3. A hydraulic system according to claim 2 wherein said control member comprises a pulse width modulated solenoid (806).

4. A hydraulic system according to claim 3 wherein the area of said surface of said hydraulic piston is substantially equal to a multiple of 2.0 of the surface area of said one of the ends of said valve operator, and wherein said valve member remains in said first position when said pulse width modulated solenoid operates on a 50% duty cycle to reduce the pressure of the source that acts on the area of said surface to substantially 50% of the pressure of the source.

5. A hydraulic system according to claim 4 wherein said valve member further comprises a portion between said first and second lands, said portion defining an hydraulic fluid flow passage with said housing of said spool valve; wherein said control means further comprises seventh conduit means in communication with said hydraulic fluid flow passage in each of said first, second and third positions of said valve member and with said first conduit means and said third conduit means, said seventh conduit means permitting the flow of hydraulic fluid from said hydraulic fluid flow passage to said first hydraulic operator and said second hydraulic operator, whereby hydraulic fluid being exhausted from one of said first hydraulic operator and said second hydraulic operator will be returned to the other of said first hydraulic operator and said second hydraulic operator without returning to the source of hydraulic fluid.

6. A hydraulic system according to claim 5 further comprising check valve means for preventing flow of hydraulic fluid from said first hydraulic operator and said second hydraulic operator through said first conduit means and said third conduit means into said seventh conduit means.

7. A hydraulic system according to claim 6 wherein said valve member has an internal passage for permitting flow of hydraulic fluid from the source of hydraulic fluid through said valve member from said one of the opposed ends to said hydraulic fluid flow passage, said internal passage having internal passage check valve means for preventing flow from said hydraulic fluid flow passage back through said internal passage.

8. An hydraulic system according to claim 7 wherein said valve member further comprises an extension extending beyond one of the ends thereof and wherein said first surface is a surface on said extension and extends generally parallel to said one of the ends.

9. A hydraulic system according to claim 8 wherein said centering means comprises first compression spring member (802) acting on said first opposed end of said valve member and second compression spring member (804) acting on said hydraulic piston, said first and second compression spring members imposing oppositely directed loads, said oppositely directed loads being substantially equal in magnitude when said valve member is in said first position.

10. A hydraulic system according to claim 9 wherein said biasing means comprises:

eighth conduit means (839) for delivering hydraulic fluid from said source to a cavity located within said force imposing means;

a biasing ring (835), said biasing ring contained within said cavity and slidably engaged therein, said biasing ring capable of lateral movement parallel to said hydraulic piston, movement of said biasing ring responsive to hydraulic fluid at substantially the pressure from said source;

a third compression spring member (804*a*), said third compression spring member acting upon said biasing ring to provide a force in an direction opposite to that of the supplied hydraulic fluid, a biasing bracket (840), said biasing bracket connected to said biasing ring and extending forward of said hydraulic piston, said biasing bracket capturing said hydraulic piston and forcing said piston rearward in response to hydraulic fluid from said source at a reduced pressure contained in said cavity.

11. A hydraulic system according to claim 9 wherein said biasing means comprises:

a ninth conduit means for delivering hydraulic fluid to a cavity within said force imposing means;

a biasing piston, said biasing piston comprising a standard cylindrical piston having an axial projection, said biasing piston further comprising a cylindrical center projection, said biasing piston located within said cavity, said biasing piston capable of lateral movement within said cavity in response to hydraulic fluid at substantially the pressure from said source, said biasing piston containing said hydraulic piston therein, said biasing piston and said hydraulic piston each capable of lateral movement independent of the other; and, a biasing piston stop, said stop located forward of said biasing piston, said stop limiting the movement of said biasing piston in the forward direction.

12. In an internal combustion engine having a rotatable crankshaft and a rotatable camshaft, the camshaft being position variable in a circumferential direction relative to the camshaft, means for varying the position of the camshaft relative to the crankshaft, said means for varying comprising a source of hydraulic fluid under pressure, a first hydraulic operator connected to said crankshaft and to said camshaft, the operation of said first hydraulic operator being effective to vary the position of the camshaft relative to the crankshaft in a given circumferential direction, first conduit means for delivering hydraulic fluid from the source to the first hydraulic operator to operate the first hydraulic operator, a second hydraulic operator connected to said crankshaft and to said camshaft, the operation of said second hydraulic operator being effective to vary the position of the camshaft relative to the crankshaft in an opposed circumferential direction, second conduit means for exhausting hydraulic fluid from the first hydraulic operator, third conduit means for delivering hydraulic fluid from the source to the second hydraulic operator to operate the second hydraulic operator, fourth conduit means for exhausting hydraulic fluid from the second hydraulic operator and control means for controlling the exhausting of hydraulic fluid from the first hydraulic operator and the second hydraulic operator to selectively permit hydraulic fluid from the source to operate one or another of said first hydraulic operator and said second hydraulic operator, said control means comprising:

a spool valve in communication with said second conduit means and said fourth conduit means, said spool valve comprising a housing and a valve member, said valve member being reciprocable within said housing and comprising first and second opposed ends and first and second spaced apart lands between said opposed ends, said first land being capable of blocking flow through said second conduit means in first and third positions of said valve member and permitting flow through said second conduit means in a second position of said valve member, said second land being capable of blocking flow through said fourth conduit means in said first and second positions of said valve member and permitting flow through said second conduit means in said third position of said valve member;

fifth conduit means for transmitting hydraulic pressure from the source to act on a first surface of said valve member at substantially the pressure of the source to urge the valve member in a given direction;

force imposing means for imposing a load on said valve member to urge said valve member in an opposed direction, said force imposing means having a second surface with an area that is substantially greater than the area of said first surface;

sixth conduit means for transmitting hydraulic pressure from the source to the force imposing means to act on said second surface of said force imposing means, said sixth conduit means comprising a control member therein to controllably reduce the pressure of the source that acts on said second surface of said force imposing means;

centering means for centering said valve member in a substantially fixed position relative to said housing when the hydraulic forces acting on said valve member are in balance; and, biasing means for forcing said valve member to its full advance position during a low pressure condition of operation.

13. An internal combustion engine according to claim 12 wherein one of said first surface and said second surface is an end of said valve member, wherein said force imposing means comprises an hydraulic piston (234*a*), and wherein the other of said first surface and said second surface is a surface of said hydraulic piston.

14. An internal combustion engine according to claim 13 wherein said control member comprises a pulse width modulated solenoid (806).

15. An internal combustion engine according to claim 14 wherein the area of said surface of said hydraulic piston is substantially equal to a multiple of 2.0 of the surface area of said one of the ends of said valve operator, and wherein said valve member remains in said first position when said pulse width modulated solenoid operates on a 50% duty cycle to reduce the pressure of the source that acts on the area of said surface to substantially 50% of the pressure of the source.

16. An internal combustion engine according to claim 15 wherein said valve member further comprises a portion between said first and second lands, said portion defining an hydraulic fluid flow passage with said housing of said spool valve; wherein said control means further comprises seventh conduit means in communication with said hydraulic fluid flow passage in each of said first, second and third positions of said valve member and with said first conduit means and said third conduit means, said seventh conduit means permitting the flow of hydraulic fluid from said hydraulic fluid flow passage to said first hydraulic operator and said second hydraulic operator, whereby hydraulic fluid being exhausted from one of said first hydraulic operator and said second hydraulic operator will be returned to the other of said first hydraulic operator and said second hydraulic operator without returning to the source of hydraulic fluid.

17. An internal combustion engine according to claim 16 further comprising check valve means for preventing flow of hydraulic fluid from said first hydraulic operator and said second hydraulic operator through said first conduit means and said third conduit means into said seventh conduit means.

18. An internal combustion engine according to claim 17 wherein said valve member has an internal passage for permitting flow of hydraulic fluid from the source of hydraulic fluid through said valve member from said one of the opposed ends to said hydraulic fluid flow passage, said internal passage having internal passage check valve means for preventing flow from said hydraulic fluid flow passage back through said internal passage.

19. An internal combustion engine according to claim 18 wherein said valve member further comprises an extension extending beyond one of the ends thereof and wherein said first surface is a surface on said extension and extends generally parallel to said one of the ends.

20. An internal combustion engine according to claim 19 wherein said centering means comprises first compression spring member (802) acting on said first opposed end of said valve member and second compression spring member (804) acting on said hydraulic piston, said first and second compression spring members imposing oppositely directed loads, said oppositely directed loads being substantially equal in magnitude when said valve member is in said first position.

21. An internal combustion engine according to claim 20 wherein said biasing means comprises:

eighth conduit means (839) for delivering hydraulic fluid from said source to a cavity located within said force imposing means;

a biasing ring (835), said biasing ring contained within said cavity and slidably engaged therein, said biasing ring capable of lateral movement parallel to said hydraulic piston, movement of said biasing ring responsive to hydraulic fluid at substantially the pressure from said source;

a third compression spring member (**804*a*), said third compression spring member acting upon said biasing ring to provide a force in an direction opposite to that of the supplied hydraulic fluid, a biasing bracket (840**), said biasing bracket connected to said biasing ring and extending forward of said hydraulic piston, said biasing bracket capturing said hydraulic piston and forcing said piston rearward in response to hydraulic fluid from said source at a reduced pressure contained in said cavity.

22. An internal combustion engine according to claim 20 wherein said biasing means comprises:

a ninth conduit means for delivering hydraulic fluid to a cavity within said force imposing means;

a biasing piston, said biasing piston comprising a standard cylindrical piston having an axial projection, said biasing piston further comprising a cylindrical center projection, said biasing piston located within said cavity, said biasing piston capable of lateral movement within said cavity in response to hydraulic fluid at substantially the pressure from said source, said biasing piston containing said hydraulic piston therein, said biasing piston and said hydraulic piston each capable of lateral movement independent of the other; and, a biasing piston stop, said stop located forward of said biasing piston, said stop limiting the movement of said biasing piston in the forward direction.

23. An internal combustion engine according to claim 22 wherein said biasing piston stop is located on said camshaft body.

* * * * *